United States Patent [19]

Pittard et al.

[11] Patent Number: 5,060,738

[45] Date of Patent: Oct. 29, 1991

[54] THREE-BLADE UNDERREAMER

[75] Inventors: Fred J. Pittard, Richmond; Jimmy D. Fultz, Houston, both of Tex.

[73] Assignee: Slimdril International, Inc., Houston, Tex.

[21] Appl. No.: 586,599

[22] Filed: Sep. 20, 1990

[51] Int. Cl.[5] ..... E21D 10/32

[52] U.S. Cl. ..... 175/267; 166/55.8; 175/286; 175/406

[58] Field of Search ..... 175/267, 269, 268, 284, 175/286, 287, 384, 406; 166/55.8

[56] References Cited

U.S. PATENT DOCUMENTS

| | | | |
|---|---|---|---|
| 2,116,898 | 5/1938 | Johnson | 175/269 |
| 2,548,931 | 4/1951 | Baker | 175/269 X |
| 2,644,673 | 7/1953 | Baker | 175/269 X |
| 2,756,968 | 7/1956 | Emanuel et al. | 175/289 X |
| 2,822,150 | 2/1958 | Muse et al. | 175/409 X |
| 3,050,122 | 8/1962 | Huitt et al. | 166/55.8 |
| 3,220,478 | 11/1965 | Kinzbach | 175/269 X |
| 3,419,077 | 12/1968 | Sanford | 166/55.8 |
| 4,565,252 | 1/1986 | Campbell et al. | 175/269 |
| 4,589,504 | 5/1986 | Simpson | 175/269 X |
| 4,809,793 | 3/1989 | Hailey | 166/312 X |

*Primary Examiner*—Hoang C. Dang
*Attorney, Agent, or Firm*—Neal J. Mosely

[57] ABSTRACT

An underreamer tool has a generally cylindrical body with a threaded top end for connection to a tubing string, a threaded lower portion to receive a drill bit, and a longitudinal fluid passageway extending centrally through the body. The body has three flat surfaces formed on its exterior in circumferentially spaced relation to define a generally triangular cross section intermediate the top and bottom ends of the body. A cutter blade is pivotally mounted on each of the flat surfaces. A piston is slidably received in a bore in the upper portion of the body and has central fluid passageway therethrough. Push rod members are connected to the piston inside the body and each has an exterior portion slidably mounted in a slot on the exterior of the body engaging the cutter blades for moving them between a retracted position against the body and an extended position outward therefrom. The piston and push rod members are moveable between an upper position allowing the blades to assume the retracted position and a lower position moving the cutter blades to the extended position responsive to a predetermined fluid pressure acting thereon. A continuous fluid flow path is established from the upper end of the tool to the drill bit at the lower end of the tool regardless of the position of the piston.

13 Claims, 3 Drawing Sheets

THREE-BLADE UNDERREAMER

BACKGROUND OF THE INVENTION

1. FIELD OF THE INVENTION

This invention relates generally to borehole operating tools such as underreamers, and more particularly to an underreamer having three expandable cutter blades engaged by and controlled by a fluid operated piston.

2. BRIEF DESCRIPTION OF THE PRIOR ART

Underreamers are a type of borehole operating tool for use in enlarging an oil well borehole which was initially bored by the drill bit. A typical underreamer includes expandable arms mounted in a housing by suitable hinge pins for movement between a withdrawn or closed position and an open, expanded position. Typically, the expandable arms are moved outwardly by means of a pressure actuated piston mounted within the main bore of the tool housing. The ends of the expandable arms are usually provided with a machined surface or cutting inserts for engaging certain types of formations and cutting a larger hole than created by the drill bit. There are several patents which disclose various underreaming tools.

Simpson, U.S. Pat. No. 4,589,504 discloses a well bore enlarger which has an enlarged section defining blades and cutting arms pivotally mounted in the blades and movable by means of a spring loaded piston between a radially expanded and retracted position.

Muse et al, U.S. Pat. No. 2,822,150 discloses a rotary expansible drill bit having upper and lower cutters pivotally mounted on a main body and connected by a rack and pinion mechanism to a plunger for simultaneously expanding the cutters outwardly from the main body.

Hailey, U.S. Pat. No. 4,809,793 discloses a downhole cutting tool which includes longitudinal bores which are opened to fluid flow when the cutting members are moved to their extended positions. The tool has upper and lower subassemblies connected together through an adapter which establishes an angular offset between an upper and lower pair of extendible cutter members. In both the upper and lower subassemblies, one passage is continuously open to fluid flow at all times and the other passage is initially closed and only opens on predetermined movement of the piston or pistons which open the extendible cutters.

Baker, U.S. Pat. Nos. 2,548,931 and 2,644,673, and Huitt et al, U.S. Pat. No. 3,050,122 disclose underreamers having cutter blades pivotally mounted on a main body and connected by link members to a plunger for simultaneously expanding the cutters outwardly from the main body.

Emanuel et al, U.S. Pat. No. 2,756,968 discloses an expansible well scraper having scraper blades pivotally mounted on a main body and connected by a toothed mechanism to a plunger for simultaneously expanding the cutters outwardly from the main body.

Campbell et al, U.S. Pat. No. 4,565,252 discloses an underreamer or milling tool having simultaneously expansible arms pivotally mounted on a main body. A rotary fluid housing is mounted within each arm and includes a body nozzle for receiving fluid from the body and an expandable arm nozzle for directing fluid into a bore which extends through the arm to provide circulating fluid outwardly of the expandable arm.

The present invention is distinguished over the prior art in general, and these patents in particular by an underreamer tool having a generally cylindrical body with a threaded top end for connection to a tubing string, a threaded lower portion to receive a drill bit, and a longitudinal fluid passageway extending centrally through the body. The body has three flat surfaces formed on its exterior in circumferentially spaced relation to define a generally triangular cross section intermediate the top and bottom ends of the body. A cutter blade is pivotally mounted on each of the flat surfaces. A piston is slidably received in a bore in the upper portion of the body and has central fluid passageway therethrough. Push rod members are connected to the piston inside the body and each has an exterior portion slidably mounted in a slot on the exterior of the body engaging the cutter blades for moving them between a retracted position against the body and a extended position outward therefrom. The piston and push rod members are moveable between an upper position allowing the blades to assume the retracted position and a lower position moving the cutter blades to the extended position responsive to a predetermined fluid pressure acting thereon. A continuous fluid flow path is established from the upper end of the tool to the drill bit at the lower end of the tool regardless of the position of the piston.

SUMMARY OF THE INVENTION

It is therefore an object of the present invention to provide an underreamer tool having a set of expandable cutter blades connected and controlled by a fluid operated piston.

It is another object of this invention to provide an underreamer tool having a set of three expandable cutter blades which are expanded in planes which are 120 relative to one another to stabilize the tool at three points equally spaced around the periphery of the bore hole.

Another object of this invention is to provide an underreamer tool wherein continuous flow of fluid through internal passages is discharged to the drill bit regardless of the position of the piston.

Another object of this invention is to provide an underreamer tool having a fluid operated piston which requires no seal between the piston and the surrounding bore and allows a small amount of fluid to bypass the piston to provide cleaning action of the mechanical portions of the cutter blades by the fluid.

A further object of this invention is to provide an underreamer tool wherein a set of cutter blades are pivotally mounted on a relatively large pivot pin and are supported on a flat surface surrounding the pivot pin to reinforce and accurately maintain the blades in their expanded position.

A still further object of this invention is to provide an underreamer tool which is simple in construction, economical to manufacture, and rugged and reliable in use.

Other objects of the invention will become apparent from time to time throughout the specification and claims as hereinafter related.

The above noted objects and other objects of the invention are accomplished by an underreamer tool having a generally cylindrical body with a threaded top end for connection to a tubing string, a threaded lower portion to receive a drill bit, and a longitudinal fluid passageway extending centrally through the body. The body has three flat surfaces formed on its exterior in circumferentially spaced relation to define a generally triangular cross section intermediate the top and bottom ends of the body. A cutter blade is pivotally mounted on each of the flat surfaces. A piston is slidably received in a bore in the upper portion of the body and has central fluid passageway therethrough.

Push rod members are connected to the piston inside the body and each has an exterior portion slidably mounted in a slot on the exterior of the body engaging the cutter blades for moving them between a retracted position against the body and an extended position outward therefrom. The piston and push rod members are moveable between an upper position allowing the blades to assume the retracted position and a lower position moving the cutter blades to the extended position responsive to a predetermined fluid pressure acting thereon. A continuous fluid flow path is established from the upper end of the tool to the drill bit at the lower end of the tool regardless of the position of the piston.

DESCRIPTION OF A PREFERRED EMBODIMENT

Figure 1:
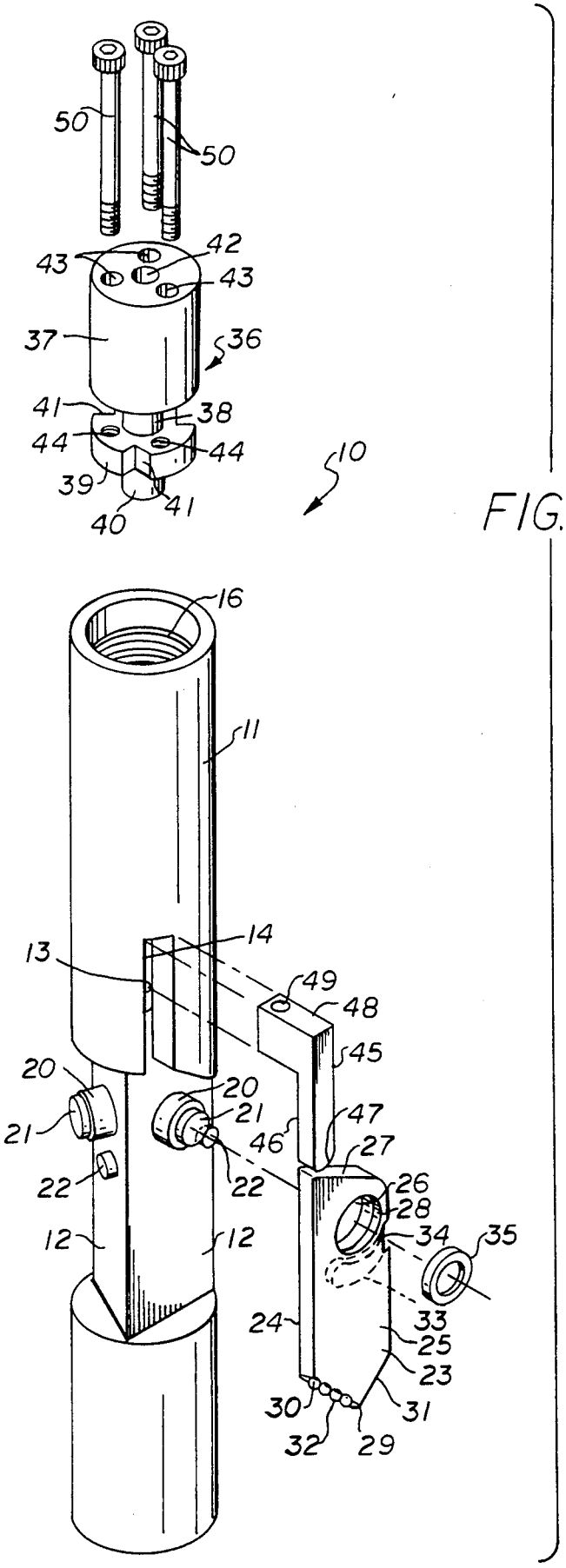
FIG. 1 is an exploded isometric view of a three-blade underreamer tool in accordance with the present invention.

Referring to the drawings by numerals of reference, there is shown in FIGS. 1–7, a preferred three-blade underreamer tool 10. The tool 10 has an elongate cylindrical body 11. Three flat surfaces 12 are milled on the exterior of the body 11 in circumferentially spaced relation to form a generally triangular cross section intermediate the top and bottom ends of the body and define an upper portion and lower portion of the body. A vertical slot 13 extends upwardly a distance from each flat surface 12, and the upper portion of the slot 13 has a horizontal slotted portion 14 which extends from the slot 13 to the interior of the body 11.

Figure 4:
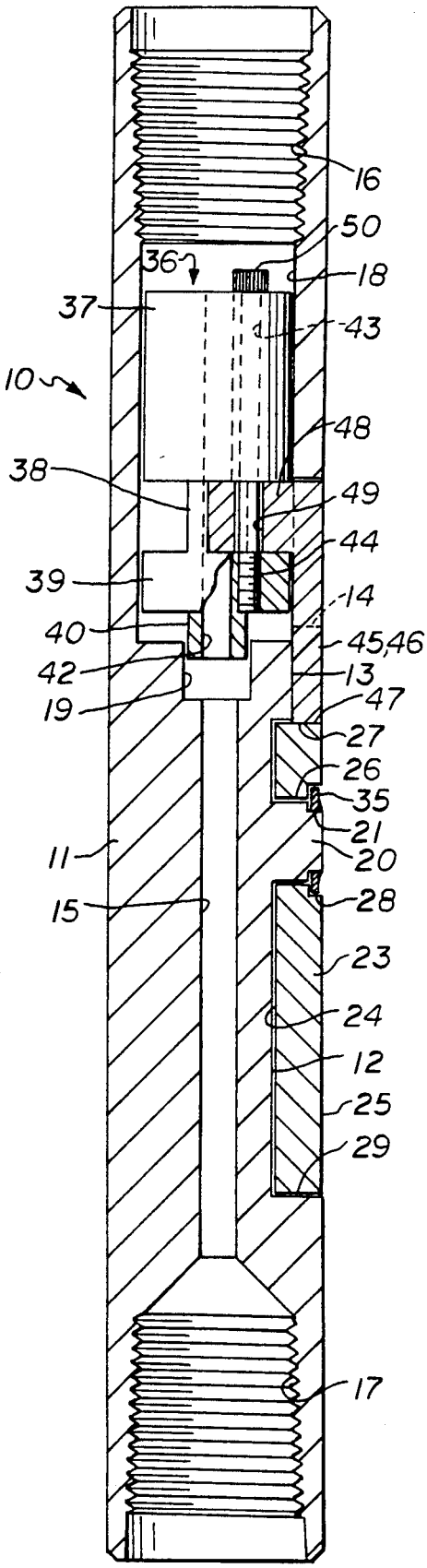
FIG. 4 is a longitudinal cross section of the three-blade underreamer taken along line 4—4 of FIG. 2 showing the cutter blades in the retracted position.
Figure 7:
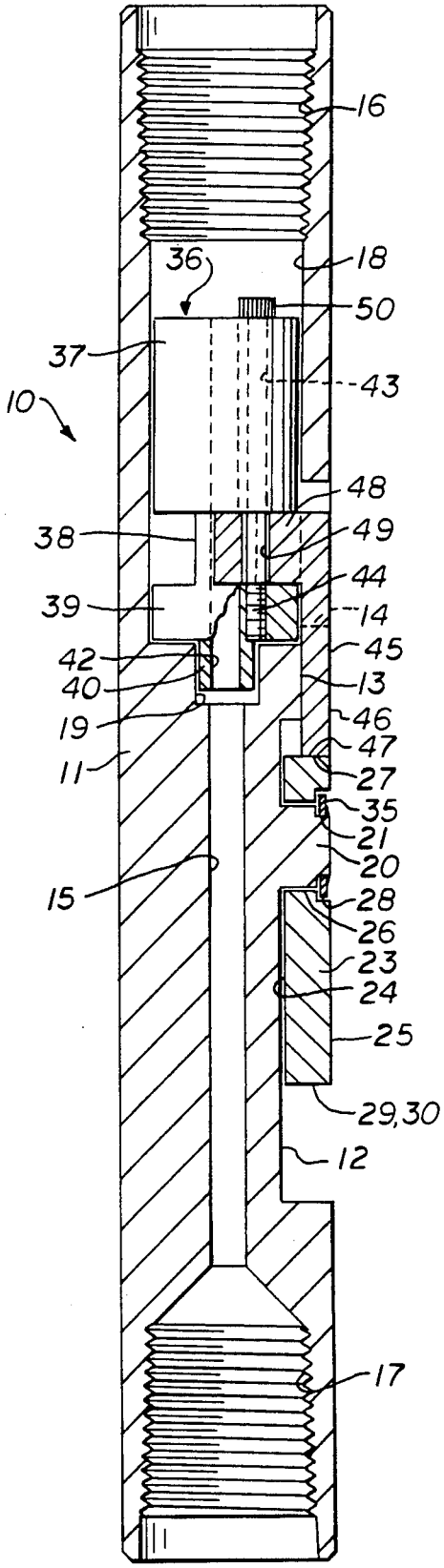
FIG. 7 is a longitudinal cross section of the three-blade underreamer taken along line 7—7 of FIG. 5 showing the cutter blades in the extended position.

As best seen in FIGS. 4 and 7, the interior of the body 11 has a longitudinal small diameter central bore 15 extending therethrough. Interior threads 16 are provided at the top end of the upper portion and interior threads 17 are formed in the bottom end of the lower portion of the body 11. A suitable drill bit (not shown) is threadedly connected at the lower end of the tool body.

A central bore 18 extends downwardly from the interior threads 16 in the upper portion of the body 11 and terminates in a small diameter bore 19. The bore 19 is larger in diameter than the central bore 15 and the bore 18 is larger in diameter than the bore 19. The horizontal slotted portion 14 of the vertical slot 13 extends inwardly from the upper portion of the vertical slot 13 to the bore 18.

A cylindrical projection or pivot pin 20 extends radially outward from each flat surface 12 near its upper end and the extended end of the pivot pin has a reduced diameter portion 21. A small diameter projection or stop pin 22 extends radially outward from each flat surface 12 below and laterally offset from the pivot pin 20.

Three cutter blades 23 are pivotally mounted, one on each pivot pin 20 onto the flat surfaces 12. Each blade 23 is a rectangular member having a flat inner side 24 and a rounded exterior side 25. A hole 26 extends through each blade 23 near its top end 27 and is counterbored 28 at the exterior side. The top end 27 of each blade 23 slopes downward at an angle and is rounded at the ends of the sloped surface. The bottom end 29 of each blade 23 is angled upwardly at each side to form flat surfaces 30 and 31. The flat surface 30 on one side of each blade 23 is angled such that when the blades are expanded outward from the tool, the flat surface 30 will be generally perpendicular to the longitudinal tool axis. The bottom ends of the cutter blades may be provided with a machined surface, cutting inserts, or wear inserts 32 for engaging certain types of formations and cutting a larger hole than created by the drill bit.

Figure 2:
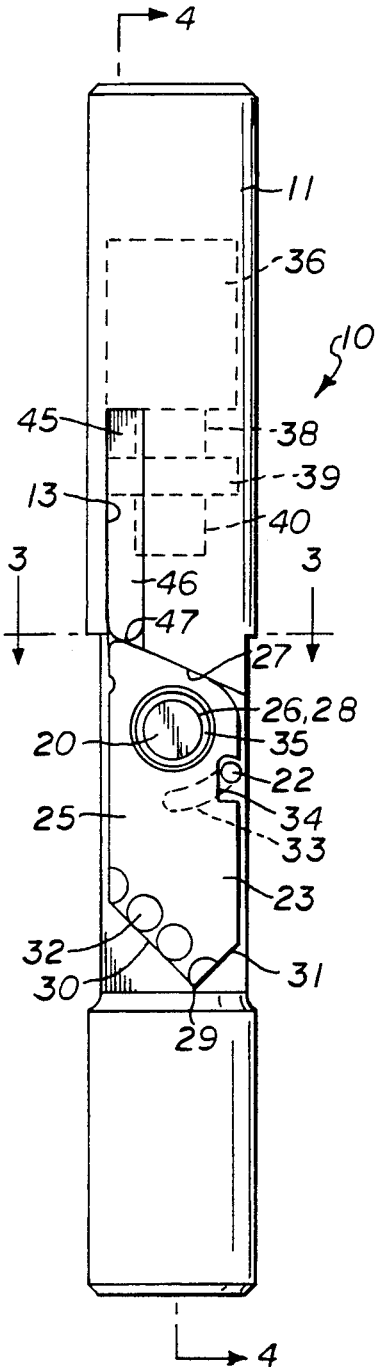
FIG. 2 is a side elevation of the three-blade underreamer tool showing the blades in a retracted position.
Figure 6:
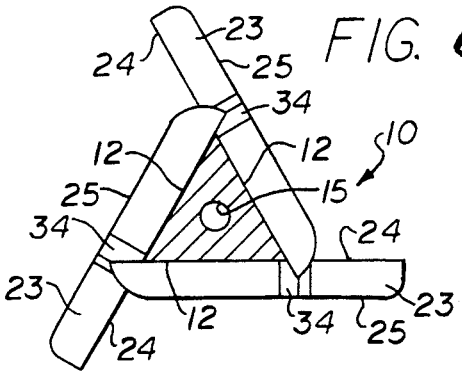
FIG. 6 is a top plan view of the three-blade underreamer tool showing the cutter blades in the extended position.
Figure 5:
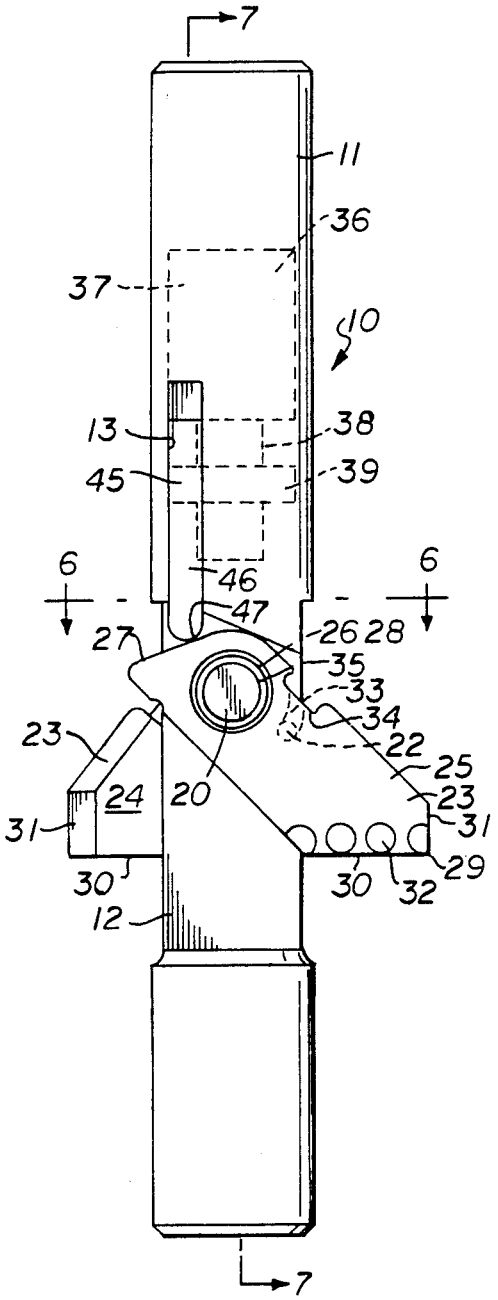
FIG. 5 is a side elevation of the three-blade underreamer tool showing the blades in an extended position.

An arcuate slot 33 is formed in the flat inner side 24 of each blade 23 which curves inwardly from one side edge of the blade. The side edge of each blade 23 is provided with a recess or notch 34 near its top end (FIGS. 1, 2, and 5). Each blade 23 is slidably received on a pivot pin 20 and a washer 35 is welded onto the reduced diameter 21 of the pin 20 to secure the blades rotatably onto the pivot pins. It should be understood that the blades could also be secured onto the pivot pins by snap rings or other conventional fastener means. The higher corner of the top end 27 of each blade 23 is disposed beneath the vertical slot 13. When the blades 23 are mounted, the small diameter stop pin 22 is received in the arcuate curved slot 33 on the inner side of the blade. It should be noted that when the blades are in the extended position, their top ends will overlap to be received in the notches 34 (FIG. 6).

A generally cylindrical piston 36 is slidably received in the upper bore 18 of the body 11. The piston 36 has a cylindrical upper portion 37 and a reduced diameter portion 38 therebelow which defines a radial flange 39 spaced below the bottom of the upper portion 37. A reduced diameter guide portion 40 extends downwardly from the bottom of the flange 39 to be slidably received in the bore 19 of the body 11. The periphery of the flange 39 has three inwardly notched portions 41 in circumferentially spaced relation. A central bore 42 extends longitudinally through the piston 36. Three holes 43 extend longitudinally through the upper portion 37 of the piston 36 near its outer periphery in circumferentially spaced relation, and three threaded holes 44 extend through the flange 39 in axial alignment with the holes 43. The piston 36 does not require a seal between its outer diameter and the respective bores 18 and 19 of the body 11.

A push rod 45 is slidably received in the vertical slot 13 above each cutter blade 23 and connected to the piston 36. Each push rod 45 is an inverted, generally L-shaped member having a vertical leg 46 with a rounded bottom end 47 and a horizontal leg 48. The horizontal leg 48 has a hole 49 extending therethrough. The push rod 45 is connected to the piston 36 by placing the piston 36 into the bore 18 of the body 11 and placing the push rod 45 into the vertical slot 13. In this position, the horizontal leg 48 of the push rod 45 extends through the horizontal slot 14 and positioned above the flange 39 of the piston 36. Cap screws 50 are then placed into the holes 43 of the piston 36. The shaft of the cap screws 50 extend through the holes 49 in the horizontal legs 48 of the push rods 45 and ar threadedly received in the threaded holes 44 in the piston flange 39.

Figure 3:
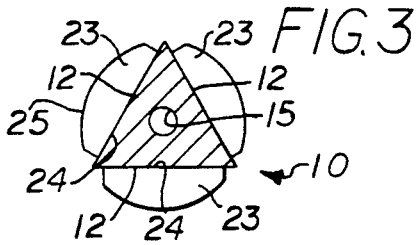
FIG. 3 is a top plan view of the three-blade underreamer tool showing the cutter blades in a retracted position.

As seen in FIGS. 2, 3, and 4, in the retracted position, the cutter blades 23 are disposed vertically against the flat surfaces 12. In the retracted position, the curved outer side 25 of the blades 23 substantially conform to the outer diameter of the tool. In this position, the piston 36 is in a raised position within the bore 18 with its guide portion 40 at the upper end of the bore 19. The push rod 45 connected to the piston 36 has its rounded bottom end 47 resting on the higher corner of the top end 27 of the cutter blade 23. The piston 36 is moved between the upper position and a lower position.

As the piston 36 moves to the lower, or extended blade position, seen in FIGS. 5, 6, and 7, the push rod 45 moves down and its rounded bottom end 47 presses down on the higher corner of the top end 27 of the cutter blade 23. This action pivots the cutter blade 23 about the pivot pin 20 and forces the bottom end 29 of the cutter blade outwardly. The flat surface 30 on one side of the blade 23 is angled such that when the blades are expanded outward from the tool, the flat surface 30 will be generally perpendicular to the longitudinal tool axis for engaging certain types of formations and cutting a larger hole than created by the drill bit. When the blades are in the extended position, their top ends will overlap and be received in the notches 34.

It should be noted that the central bores 42 and 15 of the piston 36 and body 11, respectively, form a complete fluid flow passageway from above the top of the piston to the bottom of the body to allow continuous flow of fluid through the tool to the drill bit regardless of the position of the piston. A sufficient increase in pressure above the piston 36 causes downward pressure on the top of the piston to press the push rods 45 down on the top ends 27 of the cutter blades 23 causing the cutter blades to pivot outward. The increased fluid pressure will cause a portion of the fluid to bypass the circumference of the piston and be ejected to the exterior of the tool through the horizontal slotted portion 14 of the vertical slot 13 and onto the cutter blades when they are in the extended position whereby the blades are continuously cleaned during operation.

The present underreamer tool is quickly assembled and disassembled by installing or removing the caps screws 50 for servicing or replacing the components.

OPERATION

The initial state of the tool 10 is with both the cutter blades 23 retracted (FIGS. 2, 3, and 4). The tool is lowered through tubing inside a cased well bore or into an open cased well bore with the cutter blades retracted. Drilling fluid from the drilling motor or from the end of the drill pipe at the upper end of the tool introduces sufficient fluid pressure to move the piston 36 downward to expand the cutter blades partially to the point of engaging the tubing or casing wall. At this stage, flow of drilling fluid through the central bores 42 and 15 is applied primarily to the drill bit and some venting is achieved as a result of fluid bypass around the piston 36.

As the lower end of the tool moves below the bottom end of the tubing by the reaming action of the drill bit, the lower ends of the blades move into the drilled out portion. When the bit has drilled a sufficient distance such that the blades are below the lower end of the tubing or casing, fluid pressure on the piston 36 moves it downward, forcing the cutter blades to the fully extended position (FIGS. 5, 6, and 7). In the extended position, the extended cutter blades 23 engage the wall of the casing or the hole being cut and their top ends overlap to stabilize the blades in the extended position. Since the cutter blades extend in planes at 120 to each other, the tool is stabilized at three points equally spaced around the periphery of the hole.

On completion of the underreaming or clean-out operation, flow of drilling fluid is discontinued, thus discontinuing application of pressure to the piston, and on retraction of the tool through the tubing, the cutter blade members are retracted on engagement with the tubing wall.

Since there is no seal between the piston and the central bore 18, there is a small amount of fluid which is allowed to bypass the piston and be discharged onto the cutter blades allowing cleaning action of the mechanical portions of the cutter blades by the fluid.

While this invention has been described fully and completely with special emphasis upon several preferred embodiments, it should be understood that within the scope of the appended claims the invention may be practiced otherwise than as specifically described herein.

We claim:

1. A downhole cutting tool comprising;

a generally cylindrical main body member having an upper end configured to receive a tubular member and a lower end configured to receive drill means, a longitudinal fluid passageway extending centrally through said body member, and a central bore in the upper end, flat surfaces formed on the outer periphery of said main body member intermediate the upper and lower ends, cutter blade members pivotally mounted on said flat surfaces, a piston member slidably received in said central bore and having a fluid passageway therethrough to form a continuous fluid flow path from the upper end to the lower end of the tool, and push rod members connected to said piston member and each push rod member having a portion slidably movable with said piston in said central bore and a portion extending to the exterior of said body member and slidably engaging an associated cutter blade member for moving the same between a retracted position against said body member and an extended position outward therefrom, said piston member and said push rod moveable between a first position allowing said blades to assume the retracted position and a second position moving said cutter blade members to the extended position responsive to a predetermined fluid pressure acting thereon.

2. A tool according to claim 1 in which the top end of said body member has box threads for connection to a string of tubing and the bottom end of said body member has box threads for receiving drill means.

3. A tool according to claim 1 in which said body member has three said flat surfaces on its exterior in circumferentially spaced relation to form a generally triangular cross section intermediate the top and bottom ends of said body member.

4. A downhole cutting tool comprising:

a generally cylindrical main body member having an upper end configured to receive a tubular member and a lower end configured to receive drill means, a longitudinal fluid passageway extending centrally through said body member, and a central bore in the upper end, flat surfaces formed on the outer periphery of said main body member intermediate the upper and lower ends, cutter blade members pivotally mounted on said flat surfaces, said body member having a slot extending from said central bore to the exterior of said body member, a piston member slidably received in said central bore and having a fluid passageway therethrough to form a continuous fluid flow path from the upper end to the lower end of the tool, and push rod members connected to said piston member and having a portion slidably mounted on the exterior of said body member engaging said cutter blade members for moving the same between a retracted position against said body member and an extended position outward therefrom, said push rod members having a horizontal upper portion extending through said slot and connected to said piston member and having a vertical portion slidably mounted on the exterior of said body member and the lower end thereof engaging said cutter blade members, said piston member and said push member moveable between a first position allowing said blades to assume the retracted position and a second position moving said cutter blade members to the extended position responsive to a predetermined fluid pressure acting thereon.

5. A tool according to claim 4 in which said slot has a vertical portion extending upwardly a distance from each said flat surface and has a horizontal slotted portion extending from the upper portion of said vertical slot to the interior of said body member, and said push rod vertical portion slidably received in said slot vertical portion and its horizontal portion extending through said slot horizontal portion.

6. A tool according to claim 4 in which said piston member comprises a cylindrical member having a cylindrical upper portion and a reduced diameter portion therebelow defining a radial flange spaced below the bottom of the upper portion, and each said push rod horizontal portion is connected to said flange.

7. A tool according to claim 1 in which said body member has a pivot pin extending outward from each flat surface near its upper end, and each cutter blade member is rotatably secured on said pivot pin.

8. A tool according to claim 7 in which said body member has a stop pin extending outward from each flat surface below and laterally offset from each said pivot pin.

9. A downhole cutting tool comprising:

a generally cylindrical main body member having an upper end configured to receive a tubular member and a lower end configured to receive drill means, a longitudinal fluid passageway extending centrally through said body member, and a central bore in the upper end, flat surfaces formed on the outer periphery of said main body member intermediate the upper and lower ends, cutter blade members pivotally mounted on said flat surfaces by pivot pins thereon, each said cutter blade comprises a rectangular member having a flat inner side, a rounded exterior side, and a top end above the pivotal connection, and bottom end, and said top end sloping downward at an angle and rounded at the ends of the sloped surface, a piston member slidably received in said central bore and having a fluid passageway therethrough to form a continuous fluid flow path from the upper end to the lower end of the tool, and push rod members connected to said piston member and having a portion slidably mounted on the exterior of said body member engaging said cutter blade members for moving the same between a retracted position against said body member and an extended position outward therefrom, said piston member and said push rod members moveable between a first position allowing said blades to assume the retracted position and a second position moving said cutter blade members to the extended position responsive to a predetermined fluid pressure acting thereon.

10. A tool according to claim 9 in which a predetermined downward pressure on the top of said piston member will force said push rod bottom ends against the top ends of said cutter blades to cause the lower portion of said cutter blades to pivot outward in a scissors action.

11. A tool according to claim 9 in which the bottom end of each said cutter blade is angled such that when said blades are expanded outward from said tool, said bottom ends will be generally perpendicular to the longitudinal tool axis.

12. A tool according to claim 9 in which the bottom ends of said cutter blades have inserts for engaging and cutting predetermined types of formations.

13. A tool according to claim 9 in which said body member has a stop pin extending outward from each flat surface below and laterally offset from each said pivot pin, and each said cutter blade member has an angled bottom end and an arcuate slot in said flat inner side to receive said stop pin, whereby said stop pin will limit the pivotal movement of said cutter blades in the expanded position such that the angled bottom end of each said cutter blade will be generally perpendicular to the longitudinal tool axis.

* * * * *